US005795087A

United States Patent [19]

Brower et al.

[11] Patent Number: 5,795,087

[45] Date of Patent: Aug. 18, 1998

[54] PIVOTING ROLLER FOR SKEWLESS DOCUMENT FEED

[75] Inventors: David Campbell Brower, Wake Forest; Robert Andrew Myers, Cary; Jeff David Thomas, Raleigh, all of N.C.

[73] Assignee: International Business Machines Corporation, Armonk, N.Y.

[21] Appl. No.: 842,617

[22] Filed: Apr. 15, 1997

[51] Int. Cl.[6] ..... B41J 13/02

[52] U.S. Cl. ..... 400/636; 400/624; 271/125; 271/250

[58] Field of Search ..... 400/636, 636.1, 400/579, 629, 630, 625, 624; 101/228, 227; 271/119, 245, 248, 250, 270, 273, 274, 125

[56] References Cited

U.S. PATENT DOCUMENTS

| | | | |
|---|---|---|---|
| 4,179,224 | 12/1979 | Feldman et al. | 400/637 |
| 4,335,971 | 6/1982 | deMey, II . | |
| 4,502,804 | 3/1985 | Willcox | 400/636 |
| 4,621,801 | 11/1986 | Sanchez | 400/633 |
| 4,919,318 | 4/1990 | Wong . | |
| 5,187,528 | 2/1993 | Nishikawa et al. . | |
| 5,188,468 | 2/1993 | Dykes | 400/579 |
| 5,276,460 | 1/1994 | Miyajima . | |
| 5,460,457 | 10/1995 | Mindler et al. . | |
| 5,507,482 | 4/1996 | Tenpaku et al. . | |
| 5,524,994 | 6/1996 | Hirano et al. | 400/579 |
| 5,660,489 | 8/1997 | Ishii et al. | 400/629 |

OTHER PUBLICATIONS

"Skewed Drive", IBM Technical Disclosure Bulletin; vol. 23, No. 5, pp. 1817–1819 Oct. 1980.

"Pivoting Registration Roll for Bidirectional Registering Sheet Feed", IBM Technical Disclosure Bulletin, vol. 26 No. 7A p. 3133 Dec. 1983.

"Improved Bidirectional Document Aligner", IBM Technical Disclosure Bulletin, vol. 30, No. 5 pp. 339–340 Oct. 1987.

*Primary Examiner*—Eugene H. Eickholt

*Attorney, Agent, or Firm*—John D. Flynn; Winstead Sechrest & Minick

[57] ABSTRACT

A pressure roller drive assembly for a document printer having a pressure roller carried by a pressure roller axle for advancing and retracting a document along a paper path, with the pressure roller pivoting in a first direction towards a side wall to prevent skew or misalignment during advancement of the document and the pressure roller pivoting in a second, opposite direction towards a side wall to prevent skew or misalignment during retraction of the document is disclosed.

19 Claims, 7 Drawing Sheets

PIVOTING ROLLER FOR SKEWLESS DOCUMENT FEED

CROSS-REFERENCE TO RELATED APPLICATIONS

Related subject matter may be found in the following commonly assigned, co-pending U.S. patent applications, which are hereby incorporated by reference herein:

(1) Ser. No. 08/781,771, entitled "Check Flipper for Point of Sale Printer and Method Therefor" by Richard H. Harris, et al. filed Jan. 10, 1997; and (2) Ser. No. 08/781,700, entitled "A Document Feed Roller Opener and Method Therefor" by Richard H. Harris, et al., filed Jan. 10, 1997; and (3) Ser. No. 08/781,633, entitled "Curvilinear Pressure Pad for Improved MICR Reading and Method Therefor" by Robert A. Myers, filed Jan. 10, 1997.

TECHNICAL FIELD OF THE INVENTION

The invention is drawn to the field of document printers and plotters in general, and specifically to document printers and plotters having the capability to advance and retract a document.

BACKGROUND INFORMATION

Document printers adapted for printing loose, single sheet documents such as checks or regular sheets of 8.5"×11" or A4 paper are well known. Such single sheet document printers do not rely upon "tractor feed" or other positive means of advancing a document. Rather, these printers are generally provided with rollers or belts which directly contact the document and urge it along a paper path. Ideally, the rollers move the documents along a path that is perpendicular to the axis of the roller. Furthermore, in these printers, the belts or rollers are controlled by a central processing unit. The central processing unit periodically issues "move commands" which cause the belts or rollers to turn in a forward or a reverse direction. The distance the document moves with each move command is determined by some combination of roller diameters, gear diameters and a length of time in which a drive motor is engaged. These factors must be tightly controlled in order to eliminate the need for a feedback system which would sense and measure actual movement and position of the document. In order to achieve high quality printing, document positioning must be precise.

Typically, single sheet document printers are provided with a print head and an opposing platen against which the check or other document to be printed is held. The print head may employ any one of several available technologies such as ink jet, wire impact, felt pen or laser. The feeding means of single sheet document printers is commonly comprised of a feed roller and an opposing pressure roller, wherein the circumferential surfaces of both rollers are urged into contact with each other. Drive means are provided for at least one of the rollers, with the opposing roller turning in response to the friction between the roller surfaces. Alternatively, both rollers may be provided with drive means, whereby each roller would still be turned even if the rollers were separated. In either embodiment, the rollers rotate in opposite directions, so that a document inserted between the rollers will be moved a certain distance depending upon the amount of time in which the rollers are turned.

One such document printer is known as a "point of sale check printer," which many retailers have begun to use to reduce the time required for a customer to manually fill out and sign a check. Most people have encountered delays at checkout lines when another customer waits until all of his or her items are checked or scanned to begin to fill out a check for the total purchase. Faster service may be provided if the retailer uses a point of sale check printer. A point of sale check printer automatically prints information such as the date, amount of purchase and the name of the retail establishment in the proper spaces on a check, leaving only the signature line blank for the customer to sign. The process of paying by check is therefore made similar to a purchase by credit card, in which the date, the amount of the sale and the name of the retail establishment are provided for the customer, who then needs only to sign a receipt to complete the transaction.

It is known to encode data on a check using Magnetic Ink Character Recognition ("MICR") technology. In MICR technology, ferromagnetic indicia, or "magnetic ink" is used to print the customer's account number, a number identifying the bank, and the check number on each check. The magnetic ink is then readable by a MICR reader contained within the "point of sale check printer." MICR readers are used during the check clearing process to insure the proper account is charged with the amount for which the check is drawn.

MICR readers comprise a magnetic read head, a magnet and a mechanism such as the previously mentioned belts or rollers to advance and retract the check (or other document printed with magnetic ink) past the read head and the magnet.

In the case of both MICR readers and printers, documents driven by rollers may become skewed as a result of misalignment of the belts or rollers, curvature and friction associated with the guiding surfaces and the physical factors associated with the document, such as stiffness, initial curvature, wrinkles and folds. In order to provide effective reading of the MICR characters along with maintaining high quality printing, the skew of documents in a MICR printer or a printer must be tightly controlled or eliminated.

Various attempts have been made to prevent skew as a document is advanced along a paper path; however, no attempt has been made to prevent skew in a bi-directional printer. For example, in U.S. Pat. No. 5,507,482 by Tenpaku, et al., a complex mechanism is disclosed whereby biasing rollers are set at an angle to a drive roller in order to drive a sheet of paper towards a reference guide as the paper is advanced in a forward feed direction. No provision is made for bi-directional printing, and a spring is required in each embodiment of the mechanism disclosed in U.S. Pat. No. 5,507,482 to maintain the force necessary for the mechanism to urge the paper against a guide wall.

Further, U.S. Pat. No. 5,460,457 by Mindler et al., discloses a fixed roller with a tapered surface portion and a flat surface portion to urge a document toward an edge guard. The document then maintains its position in this orientation as the document is advanced in a forward feed direction. Again, no provision is made for bi-directional printing and an amount of force urging the document towards the guide wall is dependent upon the geometry of the roller wheel. This system is inflexible and does not contemplate bi-directional printing, as the roller with the tapered and flat surface is fixed in an orientation that would drive a document away from the edge guard if the roller's rotation is reversed.

U.S. Pat. No. 4,919,318 by Wong discloses an apparatus using two separate roller drive systems with a slight speed differential to maintain non-skewed feeding of a web. One of the rollers pivots in a downstream direction as a result of being driven more slowly than the other roller. This system is complicated, requires two separate drive rollers and axles along with belts and pivots for one of the rollers. Further, the apparatus is incapable of being used in a bi-directional printer and is not suitable for use in a single sheet printer.

Additionally, U.S. Pat. No. 5,276,940 by Miyajima discloses a pivoting arm to remove skew. The pivoting arm is not part of the drive mechanism, as the paper or web being printed is driven by separately located rollers. The pivoting arm has end rollers of larger diameter than the central roller area. As the continuous sheet of paper, or "web" skews, it engages one of the larger diameter end portions, causing the arm to pivot and remove the skew. This apparatus will not support single sheet printing and requires a separate drive means other than the skew removing apparatus.

U.S. Pat. No. 5,187,528 by Nishikawa et al. discloses a skew prevention mechanism in which a pair of opposing rollers (a photo-conductive drum and a heat roller) are driven at slightly different speeds in order to eliminate slack and thereby prevent skewing in the sheet of paper being printed. However, the apparatus disclosed therein cannot prevent skew in a bi-directional printer, and does not use a pivoting roller.

The apparatus disclosed in U.S. Pat. No. 4,335,971 by de Mey uses a three-part segmented roller, wherein each roller segment is threaded onto a common axle for driving a sheet of paper. Only the center segment is driven by the common axle. The roller assembly does not pivot, nor is it used in a bi-directional printer. In this apparatus, skewing is reduced by allowing the non-driven segments to slow down or speed up until the paper supply has returned to an unskewed position. The apparatus is not suitable for use in a single sheet printer.

Although each of the aforementioned patents provides unique skew reducing mechanisms, a need exists for a mechanism which prevents skew by maintaining the perpendicular orientation of a document as the document advanced and retracted by rollers, regardless of the size, thickness or other physical characteristics of the document, and regardless of the drive rollers or other apparatus implemented to advance and retract the document.

SUMMARY OF THE INVENTION

The previously mentioned needs are fulfilled with the present invention. Accordingly, there is provided, in a first form, a document feeding assembly for a document printer. The document feeding assembly includes a pressure roller axle having a first axis and a pressure roller having a second axis. The pressure roller is carried by the pressure roller axle. The pressure roller pivots between a first counterclockwise position, a second intermediate position, and a third clockwise position. The first axis and the second axis of the pressure roller are substantially collinear when the pressure roller is in the second position. The first axis and the second axis of the pressure roller cross at an angle when the pressure roller is pivoted in either the first counterclockwise position or the second clockwise position.

These and other features and advantages will be more clearly understood from the following detailed description taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
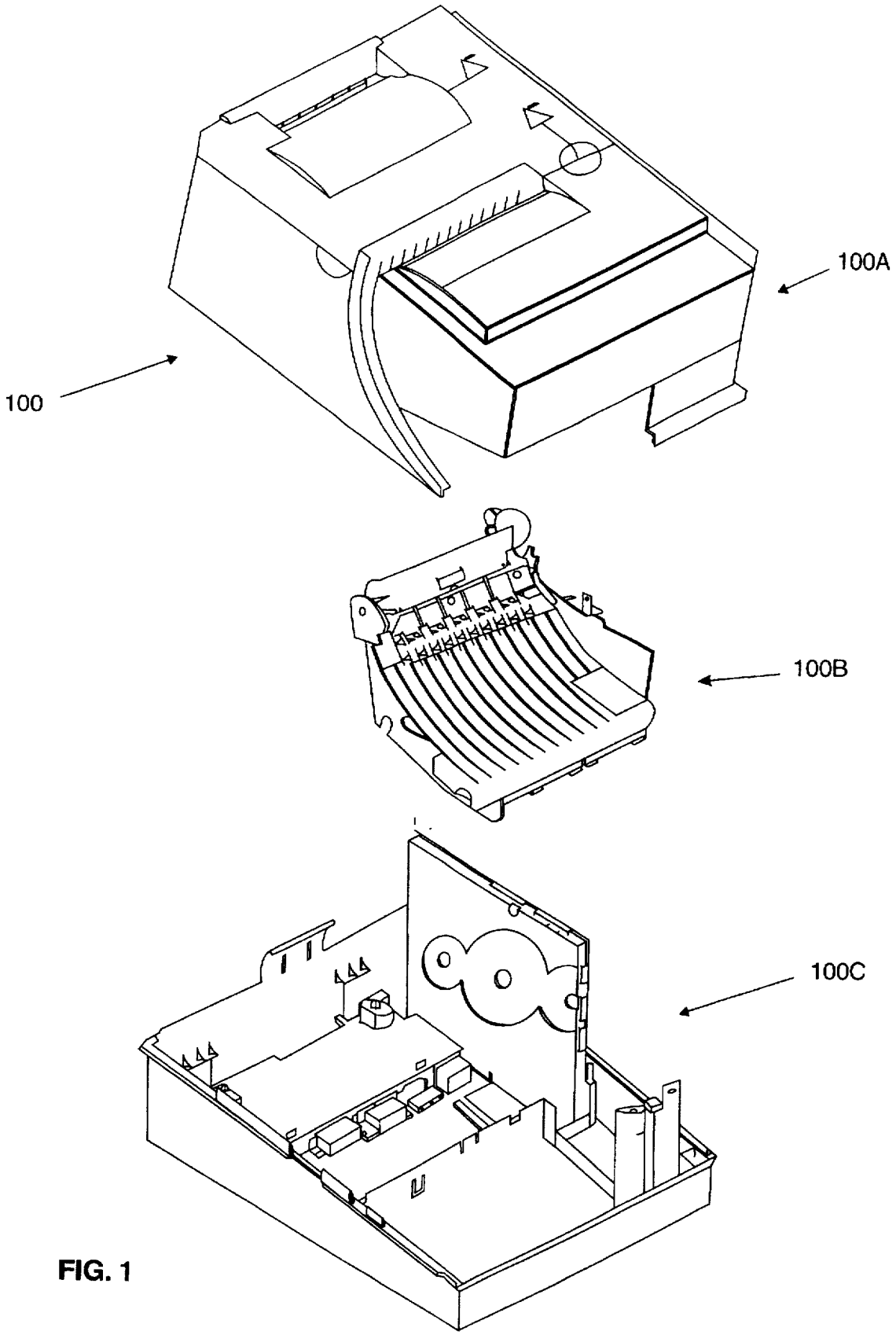
FIG. 1 is an exploded view of a point of sale check printer having a pivoting pressure roller incorporated therein in accordance with one embodiment of the present invention.

In the following description, well known elements are not described in great detail in order not to obscure the invention. For the most part, details unnecessary to obtain a complete understanding of the present invention have been omitted in as much as such details are within the skills of persons of ordinary skill in the relevant art. Additionally, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated of the same reference numeral through the several views.

FIG. 1 illustrates a view of a point of sale check printer assembly 100 having feed rollers (not illustrated in detail) and capable of bi-directional printing in accordance with one embodiment of the present invention. Upper housing **100*a* covers a printer subassembly 100*b*. Lower housing 100*c*** provides additional support, and contains logic and control circuits well known in the data processing art.

Figure 2:
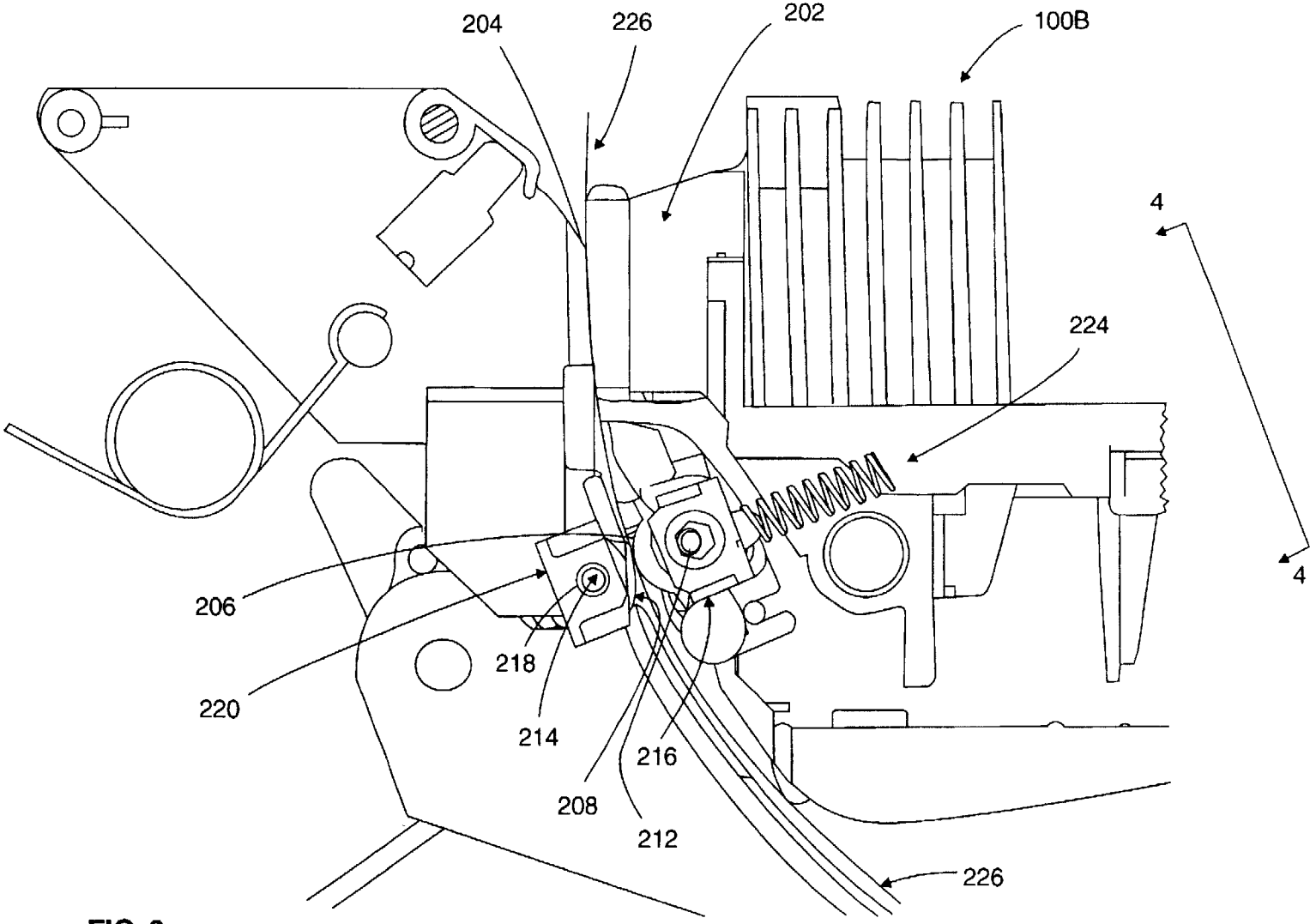
FIG. 2 is a side view of the printer subassembly of the point of sale check printer of FIG. 1.

FIG. 2 illustrates a side view of printer subassembly **100*b* of point of sale printer assembly 100. Printer subassembly 100*b* comprises a print head 202 and a platen 204. Located below print head 202 is a pressure roller 206. Located below platen 204 is a feed roller 208**.

Feed roller 208 is carried by feed roller axle 214. Pressure roller 206 is carried by pressure roller axle 212. Feed roller axle 214 and pressure roller axle 212 extend laterally through printer subassembly **100*b*. On each end of feed roller axle 214 is feed roller axle housing 220 including a bearing 218. On each end of pressure roller axle 212 is pressure roller axle housing 216**.

Also attached to printer subassembly **100*b* is a pressure feed roller spring 224. Pressure roller spring 224 pushes on pressure roller axle housing 220, and biases pressure roller 206 towards feed roller 208**.

Print head 202, platen 204, feed roller 208, and pressure roller 206 define a paper path 226 into which a check, voucher or other document, or a blank page of paper may be inserted for printing and/or for reading by a MICR reader assembly (not illustrated). As the document or page is inserted into paper path 226, the document or page passes between print head 202 and platen 204 until the document or page reaches feed roller 208 and pressure roller 206. Because pressure roller 206 is pushed against feed roller 208 and a gap therebetween is closed, the document or page will not advance further along paper path 226 until feed roller 208 and pressure roller 206 begin to turn. As illustrated in FIG. 2, a counter-clockwise rotation of pressure roller 206 and a clockwise rotation of feed roller 208 causes the document or page to be advanced further along paper path 226. A clockwise rotation of pressure roller 206 and a counter-clockwise rotation of feed roller 208 causes the document or page to be retracted along paper path 226 back towards print head 202 and platen 204.

Power to rotate feed roller 208 and pressure roller 206 is provided by a motor or other well-known power source (not illustrated). The power source may be directly linked to feed roller 208 and pressure roller 206. Alternatively, well-known drive train components such as gears, belts or idlers may be used. The control and timing of the rotation of feed roller 208 and pressure roller 206 is provided by a control circuit, such as a central processing unit (not illustrated) which may work in tandem with one or more sensors (not illustrated) placed along paper path 226.

Figure 3:
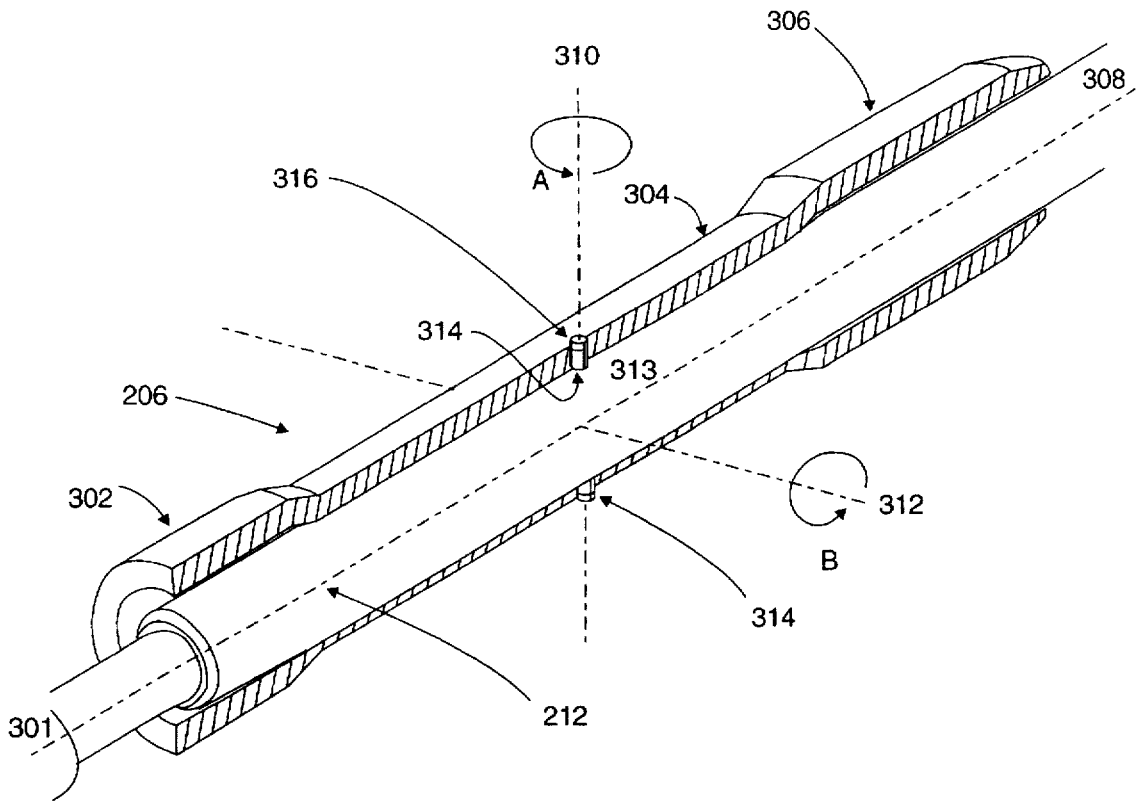
FIG. 3 is a perspective view of a pivoting pressure roller assembly in accordance with one embodiment of the present invention illustrating the pressure roller axle, a cutaway of the pressure roller, the drive pin or extensions connecting the pressure roller axle to the pressure roller and the axes around which the pressure roller twists and rocks around the pressure roller axle.

Turning now to FIG. 3, pressure roller 206 and pressure roller axle 212 are illustrated in a detailed cutaway view. Pressure roller axle 212 has an axis 301 and a relatively constant diameter. Pressure roller 206 is generally tubular in shape and is carried by pressure roller axle 212. Pressure roller 206 has a narrow roller section 302, a central section 304 and a wide roller section 306. Each of narrow roller section 302, central section 304 and wide roller section 306 has a width, an inner diameter and an outer diameter. Narrow roller section 302, central section 304 and wide roller section 306 have a common axis of rotation 308. Narrow roller section 302 has a width Wn, an inner diameter In and an outer diameter Dn. Central section 304 has a width Wc, an inner diameter Ic and an outer diameter Dc. Wide roller section 306 has a width Ww, an inner diameter Iw and an outer diameter Dw. The inner diameters of the three sections, In, Ic and Iw, are all sufficiently larger than the diameter of pressure roller axle 212 so that pressure roller 206 is allowed to twist or rock from side to side along the length of pressure roller axle 212. Stated another way, because the inner diameters In, Ic and Iw are larger than a diameter of pressure roller axle 212, axes 301 and 308 are not maintained in collinear fashion. Rather, pressure roller 206 is able to rotate along axes 310 and 312. The rotation or "twist" of pressure roller 206 along axis 310 is illustrated as "A" and the rotation or "rocking" of pressure roller 206 along axis 312 is illustrated as "B" in FIG. 3.

Axes 301, 310 and 312 intersect at a common point 313 inside pressure roller axle 212. In one embodiment of the present invention, common point 313 is approximately halfway along the length of pressure roller axle 212, however, this spacing may vary, especially when pressure roller axle 212 extends substantially beyond the width of paper path 226. Pressure roller axle 212 has extensions 314 extending along axis 310 from opposite sides of pressure roller axle 212. Extensions 314 may be the ends of a pin inserted through a hole defined along axis 310 in pressure roller axle 212, or may be formed by other well known means. Pressure roller 206 has holes 316 extending through central section 304, with each hole 316 opposite from the other. Extensions 314 extend into holes 316. In one embodiment of the present invention, holes 316 are defined in pressure roller 206 approximately halfway along the length of pressure roller 206. Thus, the lengths of the arcs along which the ends of pressure roller 206 pivot are substantially equal.

Figure 7:
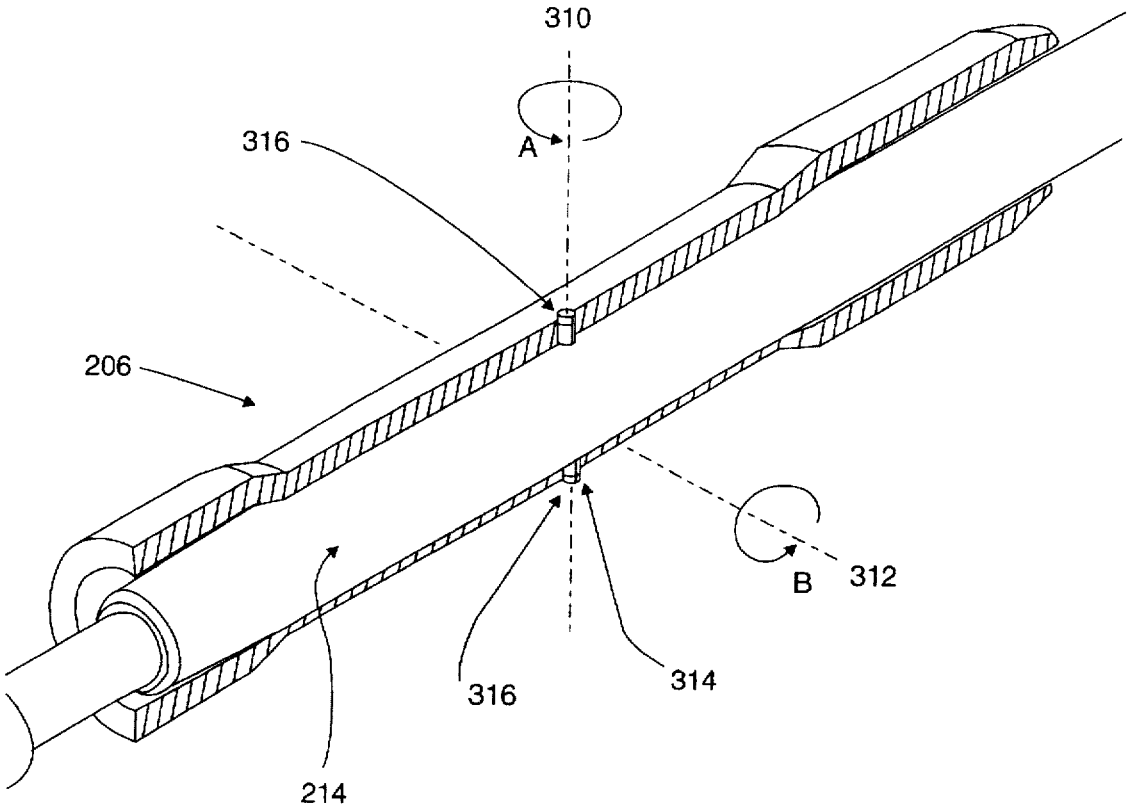
FIG. 7 is another view of the pivoting pressure roller of FIG. 3.

With extensions 314 extending into holes 316, a rotation of pressure roller axle 212 will cause pressure roller 206 to rotate. As pressure roller axle 212 and pressure roller 206 rotate, pressure roller 206 remains able to pivot and rock around axes 310 and 312. FIG. 7 illustrates enlarging one of the holes 316 into an elongated shape allows pressure roller 206 to rock around axis 312 to a greater degree. The amount by which pressure roller 206 may pivot around axis 310 or rock around axis 312 is limited by contact between inner diameters In or Iw and pressure roller axle 212. The diameter of pressure roller axle 212 may be reduced and In or Iw may be increased to increase the amount which pressure roller 206 pivots and rocks.

Figure 4:
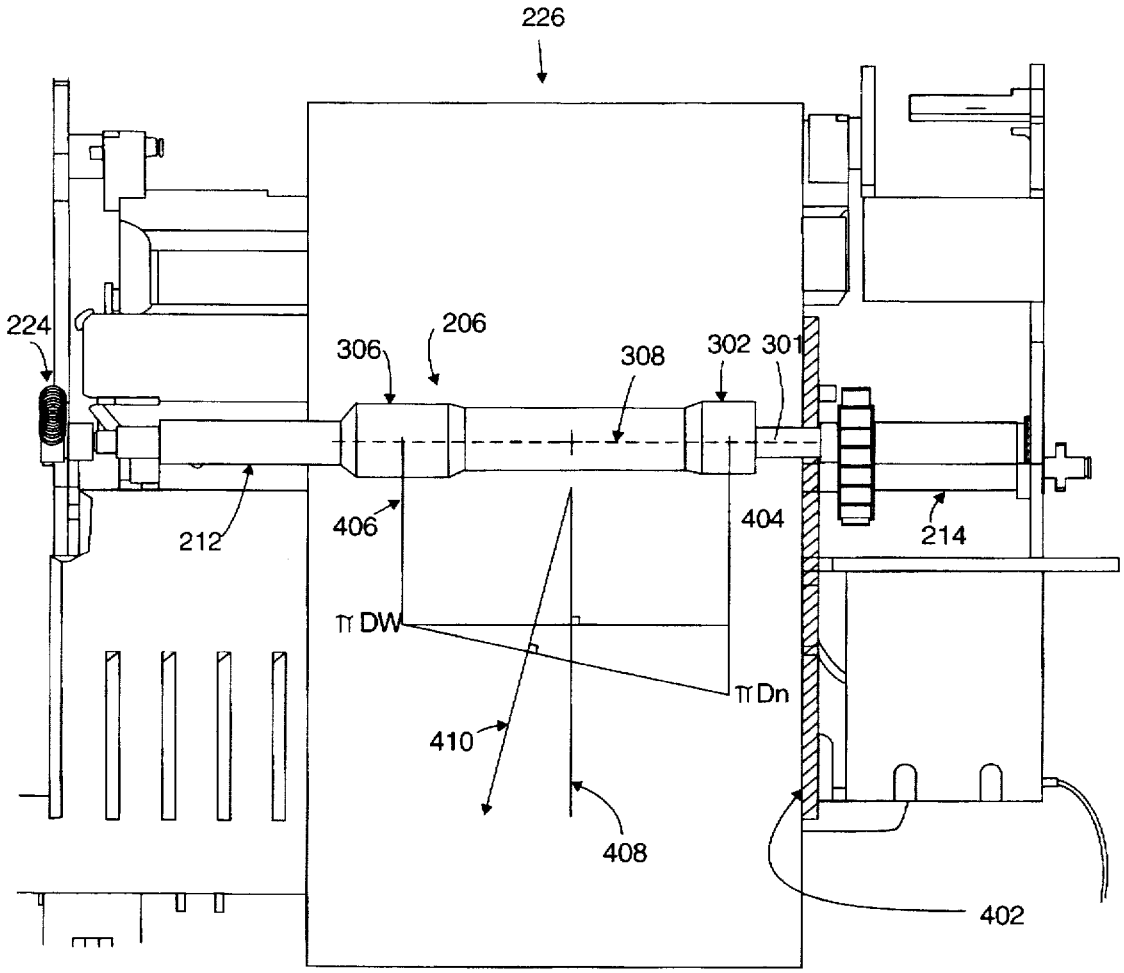
FIG. 4 is a view of the printer subassembly along line 4—4 of FIG. 2, illustrating the pressure roller in an unpivoted position.

FIG. 4 illustrates a view of printer subassembly **100*b* along line 4—4 of FIG. 2. Print head 202 has been removed and is not shown for the sake of clarity. Pressure roller 206 is carried by pressure roller axle 212. Feed roller axle 214 is partially visible. Feed roller 208 is not visible as a document has been inserted into paper path 226 past feed roller 208 and pressure roller 206**.

Attached to printer subassembly is side wall 402. Side wall 402 extends in parallel to paper path 226. A document which is held against side wall 402 will be advanced along paper path 226 in an unskewed manner. It is therefore desirable to direct the document forward along paper path 226, while concurrently urging the document sideways towards side wall 402.

Pressure roller 206 is biased toward feed roller 208 by pressure roller spring 224. A document placed between feed roller 208 and pressure roller 206 will be advanced along paper path 226. However, narrow roller section 302 and wide roller section 308 have different outer diameters, with Dn being greater than Dw (Dn>Dw). Only narrow roller section 302 and wide roller section contact the document or paper, as the diameter Dc of central section 304 is reduced. Line 404 is illustrated for reference and extends from narrow roller section 302 along paper path 226. Line 406 is also illustrated for reference and extends from wide roller section 306 along paper path 226. Line 408 is illustrated for reference and extends from central section 304 along paper path 226.

If narrow roller section 302 and wide roller section 306 were of equal diameter, the document would advance unskewed along line 408. Pressure roller 206, however, has two sections of unequal diameter in contact with the document. Narrow roller section 302, with diameter Dn, will advance the document a distance of $\pi Dn$ along line 404. Wide roller section 306, with diameter Dw will advance the document a distance of $\pi Dw$ along line 406. Because Dn>Dw, then $\pi Dn > \pi Dw$, as shown. Furthermore, if pressure roller 206 is not able to pivot, the document would skew along line 410. The illustrated skewing is an exaggeration of a typical result of advancing paper with drive rollers, as it is very difficult to control skew by providing a pair of drive rollers of equal diameter.

Figure 5:
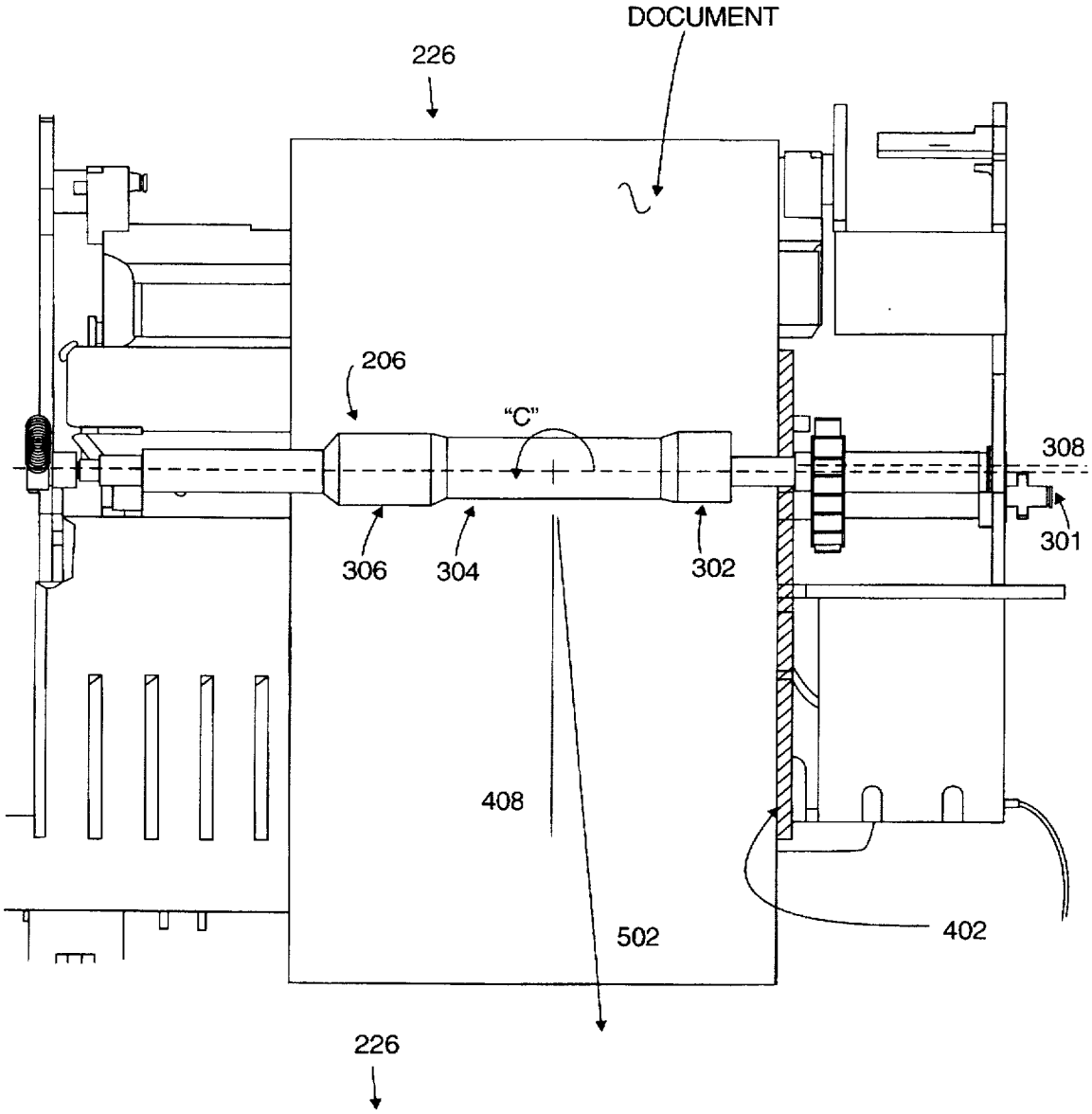
FIG. 5 is another view of the printer subassembly illustrated in FIG. 4, with a document being advanced and the pressure roller being pivoted in a counter-clockwise direction.

FIG. 5 illustrates that the twisting of pressure roller 206 along axis 310 and the rocking of pressure roller 206 along axis 312 translates to a pivoting of pressure roller 206 during rotation which eliminates skew or misalignment of the document. As pressure roller 206 pivots, pressure roller axis 308 angles away from axis 301 of pressure roller axle 212. Both narrow roller section 302 and wide roller section 306 are driven at the same rotational velocity by pressure roller axle 212, yet narrow roller section 302, with its larger diameter, tends to feed a greater length of paper than does wide roller section 306. As a result, wide roller section 306 is dragged with the paper downstream, in the direction of feed and along paper path 226, to compensate for the extra amount of paper advanced by narrow roller section 302. Narrow roller section is limited in the distance it can advance the paper because the smaller-diametered wide roller section 306 is wider and less likely to slip than is narrow roller section 302. To compensate, narrow roller section 302 shifts backward to an upstream position, opposite the direction of feed. These effects cause pressure roller 206 to pivot in a counterclockwise direction, shown as "C" in FIG. 5.

Allowing pressure roller 206 to pivot removes the skew angle from paper path 226 and transfers it to pressure roller 206. Once pressure roller 206 has pivoted, the effective direction at which the document is driven is shown as line 502. Line 502 indicates the document is generally moved in the direction of paper path 226 but is also urged towards side wall 402. It is the action of urging the document towards side wall 402 which removes skew in the printing process. Once the document has come into contact with side wall 402, pressure roller 206 will continue to hold it in such position, but pressure roller 206 will slip before the document buckles, wrinkles, or suffers edge damage from contact with side wall 208.

Figure 6:
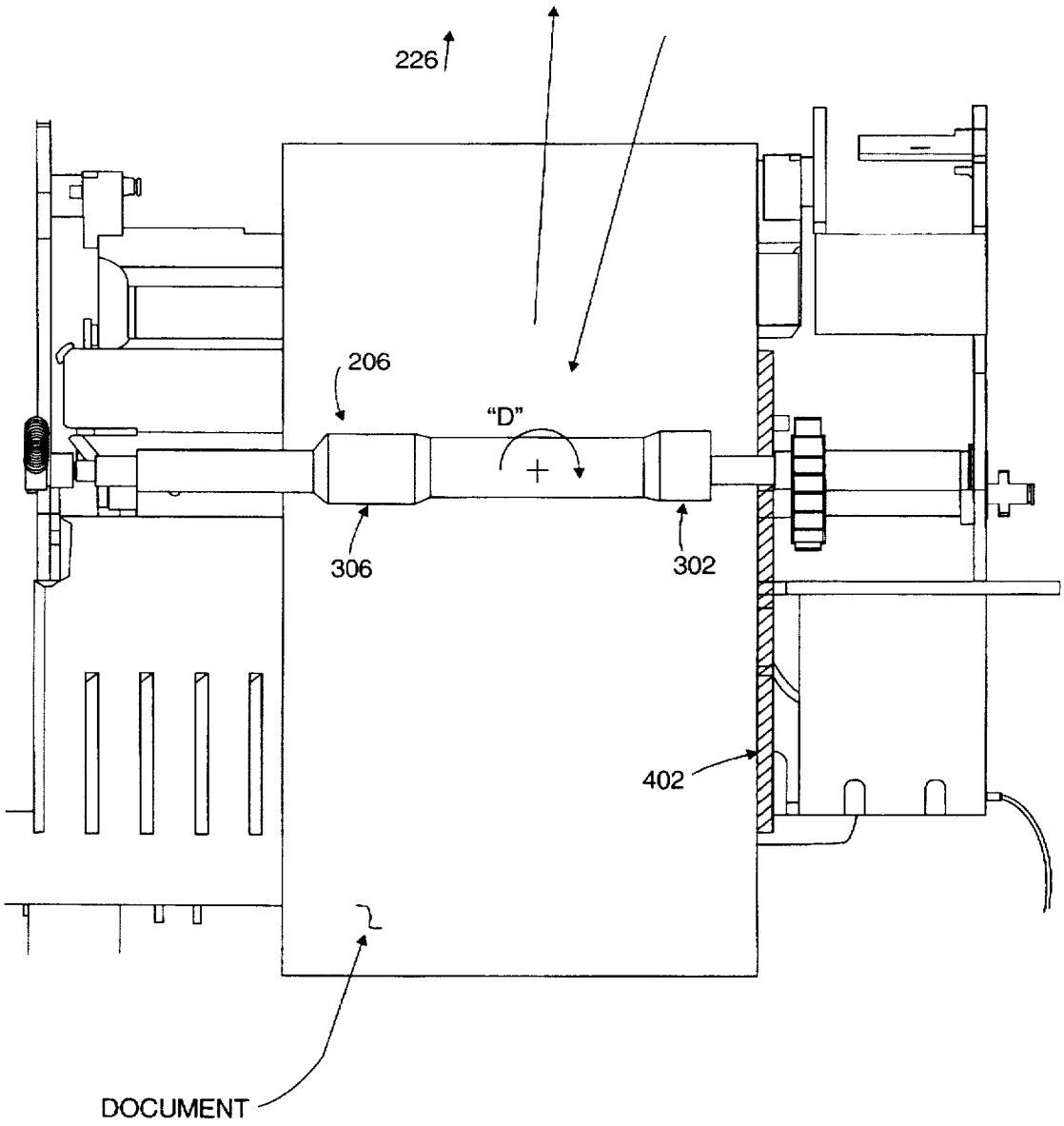
FIG. 6 is yet another view of the printer assembly of FIG. 4, with a document being retracted and the pressure roller pivoted in a clockwise direction.

FIG. 6 illustrates a view of printer subassembly **100*b* as shown in FIG. 4. However, in FIG. 6 the rotations of pressure roller 206 and feed roller 208 (not viewable) have reversed causing the document to be retracted along paper path 226 towards print head 202 (not shown) and platen 204 (not shown). In the reverse rotation, narrow roller section 302 also tends to retract the document a greater amount than does wide roller section 306 causing wide roller section 306 to drag on the document, which pivots pressure roller 206 in a clockwise direction, illustrated as "D," towards side wall 402. With pressure roller 206 so pivoted, the document is urged toward side wall 402, and skew is prevented. As with the forward rotation of the rollers, pressure roller 206 will hold the document against side wall 402, but pressure roller 206 will slip before the document buckles, wrinkles, or suffers edge damage from contact with side wall 402**.

While preferred embodiments of the invention have been shown and described, it will be apparent to those skilled in the art that the conception and the specific embodiments disclosed may be readily utilized as a basis for modifying or designing other structures for carrying out the same purpose as the present invention. As one example, the pivoting feed roller printer described herein could be used in other types of printers than point of sale check printers, such as a stand-alone printer for a computer, a fax machine, copier, or the like.

Accordingly, it should also be understood that documents other than checks are suitable for use with the invention, and that various sizes of documents and checks may be used in the invention, according to the physical dimensions of the apparatus in which the invention is installed. It should also be realized by those skilled in the art that such equivalent constructions do not depart from the spirit and scope of the invention as set forth in the appended claims.

What is claimed is:

1. A document feeding assembly for a document printer, comprising:

a pressure roller axle having a first axis;

a pressure roller having a second axis, coupled to said pressure roller axle, said pressure roller pivoting between a first counterclockwise position a second intermediate position, and a third clockwise position; and a feed roller placed against said pressure roller, wherein said first axis and said second axis are substantially collinear when said pressure roller is in said second position, wherein said first axis is at an angle to said second axis when said pressure roller pivots in either said first counterclockwise position or said third clockwise position, and wherein said feed roller has a third axis, and said first axis of said pressure roller is substantially parallel to said third axis of said feed roller.

2. A document feeding assembly for a document printer, comprising:

a pressure roller axle having a first axis;

a pressure roller having a second axis, coupled to said pressure roller axle, said pressure roller pivoting between a first counterclockwise position, a second intermediate position, and a third clockwise position;

a fourth axis perpendicular to an intersecting said first axis of said pressure roller axle;

a fifth axis perpendicular to an intersecting both said first axis and said fourth axis;

a plurality of extensions extending from said pressure roller axle along said fourth axis; and a plurality of drive holes defined in said pressure roller, wherein each of said plurality of extensions extends into a corresponding one of said plurality of holes, wherein said pressure roller pivots around said pressure roller axle around said fourth axis and said fifth axis, wherein said first axis and said second axis are substantially collinear when said pressure roller is in said second position, and wherein said first axis is at an angle to said second axis when said pressure roller pivots in either said first counterclockwise position or said third clockwise position.

3. The document feeding assembly of claim 2, wherein said pressure roller has a first section having a first diameter and a second section having a second diameter, wherein said first diameter is larger than said second diameter.

4. The document feeding assembly of claim 3, wherein said pressure roller further comprises:

a third section for separating said first section and said second section, wherein said plurality of drive holes are defined in said third section, and wherein said third section has a third diameter which is smaller than both said first diameter and said second diameter.

5. The document feeding assembly of claim 3, further comprising a side wall parallel to a paper path and perpendicular to said first axis of said pressure roller axle and said third axis of said feed roller.

6. The document feeding assembly of claim 5, wherein said pressure roller axle has a first length, a first end and a second end, wherein said fourth axis and said fifth axis intersect said first axis along said first length approximately midway between said first end and said second end, wherein said pressure roller has a second length, a third end and a fourth end, and wherein said plurality of drive holes are defined along said second length approximately midway between said third end and said fourth end.

7. The document feeding assembly of claim 6, wherein said first section is between said side wall and said second section.

8. The document feeding assembly of claim 2, wherein said pressure roller rotates in a first direction to cause a document to be advanced along said paper path in a first feed direction and said pressure roller rotates in a second direction to cause the document to be retracted along said paper path in a second feed direction, wherein the second feed direction is substantially opposite the first feed direction.

9. The document feeding assembly of claim 8, wherein said pressure roller pivots to said first counterclockwise position when said pressure roller rotates in said first direction, wherein said second section pivots in the first feed direction and said first section pivots in the second feed direction.

10. The document feeding assembly of claim 8, wherein said pressure roller pivots to said third clockwise position when said pressure roller rotates in said second direction, wherein said second section pivots in a retraction direction and said first section pivots in an advancement feed direction.

11. The document feeding assembly of claim 8, wherein said pressure roller pivots toward a side wall when said pressure roller rotates in said first direction, wherein said second section pivots in the first feed direction and said first section pivots in the second feed direction.

12. The document feeding assembly of claim 8, wherein said pressure roller pivots toward a side wall when said pressure roller rotates in said second direction, wherein said second section pivots in a direction of retraction and said first section pivots in an advancement direction.

13. A document printer, comprising:

a frame;

a print head coupled to said frame;

a platen coupled to said frame substantially opposite said print head;

a pressure roller axle coupled to said frame;

a pivoting pressure roller disposed around said pressure roller axle;

a feed roller coupled to said frame and biased toward said pressure roller;

a side wall coupled to said frame; and a paper path along which a document is fed into said document printer, said paper path defmed by said print head, said platen, said pivoting pressure roller and said side wall, with said pressure roller axle perpendicular to said paper path and said side wall parallel to said paper path, wherein said pressure roller and said feed roller cooperatively rotate in a first direction to advance said document along said paper path and said pressure roller and said feed roller cooperatively rotate in a second direction to retract said document from said paper path, wherein said pivoting pressure roller pivots toward said side wall as said document is advanced along said paper path, urging said document against said side wall to prevent misalignment of said document in relation to said paper path, and wherein said pivoting pressure roller pivots toward said side wall as said document is retracted from said paper path, urging said document against said side wall to prevent misalignment of said document in relation to said paper path.

14. A document printer, comprising:

a frame;

a print head coupled to said frame;

a platen coupled to said frame substantially opposite said print head;

a pressure roller axle coupled to said frame;

a pivoting pressure roller disposed around a pressure roller axle;

a feed roller coupled to said frame and biased toward said pressure roller;

a side wall coupled to said frame; and a paper path along which a document is fed into said document printer, said paper path defined by said print head, said platen, said pivoting pressure roller and said side wall, with said pressure roller axle perpendicular to said paper path and said side wall parallel to said paper path, wherein said pressure roller and said feed roller cooperatively rotate in a first direction to advance said document along said paper path and said pressure roller and said feed roller cooperatively rotate in a second direction to retract said document from said paper path, wherein said pivoting pressure roller pivots towards said side wall as said document is advanced along said paper path, urging said document against said side wall to prevent misalignment of said document in relation to said paper path, wherein said pivoting pressure roller pivots towards said side wall as said document is retracted from said paper path, urging said document against said side wall to prevent misalignment of said document in relation to said paper path, and, wherein said pressure roller comprises a first section with a first inner diameter and a first outer diameter, a second section with a second inner diameter and a second outer diameter, and a middle section having a third inner diameter and a third outer diameter.

15. The document printer of claim 14, wherein said second outer diameter is larger than said third outer diameter and smaller than said first outer diameter.

16. The document printer of claim 14, wherein said pressure roller axle has an outer diameter and wherein said outer diameter of said pressure roller axle is smaller than said first, second and third inner diameters of said pressure roller.

17. A document printer, comprising:

a frame;

a print head coupled to said frame;

a platen coupled to said frame substantially opposite said print head;

a pressure roller axle coupled to said frame;

a pivoting pressure roller disposed around said pressure roller axle;

a feed roller coupled to said frame and biased toward said pressure roller;

a side wall coupled to said frame; and a paper path along which a document is fed into said document printer, said paper path defined by said print head, said platen, said pivoting pressure roller and said side wall, with said pressure roller axle perpendicular to said paper path and said side wall parallel to said paper path, wherein said pressure roller and said feed roller cooperatively rotate in a first direction to advance said document along said paper path and said pressure roller and said feed roller cooperatively rotate in a second direction to retract said document from said paper path, wherein said pivoting pressure roller pivots toward said side wall as said document is advanced along said paper path, urging said document against said side wall to prevent misalignment of said document in relation to said paper path, wherein said pivoting pressure roller pivots toward said side wall as said document is retracted from said paper path, urging said document against said side wall to prevent misalignment of said document in relation to said paper path, and, wherein said pressure roller axle has a plurality of extensions extending from opposite sides of said pressure roller axle and a middle section defining a plurality of holes therethrough, wherein said plurality of extensions extend into said plurality of holes.

18. The document printer of claim 17, wherein said plurality of extensions form a first axis about which said pressure roller pivots, and further comprising a second axis intersecting and perpendicular to said first axis about which said pressure roller pivots.

19. A method of advancing a document through a printer, comprising the steps of:

providing a printer having a paper path, a pressure roller, a pressure roller axle and a side wall parallel to said paper path, said pressure roller having a first section having a first diameter and a second section having a second diameter, wherein said first diameter is larger than said second diameter;

inserting a document in said paper path until said document reaches said pressure roller;

advancing said document further along said paper path by rotation of said pressure roller in an advancement rotation, wherein said pressure roller pivots in a first orientation during said advancement rotation, concurrently urging said document toward said side wall and along said paper path;

retracting said document along said paper path by rotation of said pressure roller in a retraction rotation, and wherein said pressure roller pivots in a second orientation during said retraction rotation, concurrently urging said document toward said side wall and along said paper path; and removing said document from said paper path.

* * * * *